US012805573B2

(12) United States Patent
Sutton et al.

(10) Patent No.: US 12,805,573 B2
(45) Date of Patent: Nov. 24, 2026

(54) AEROSOL DELIVERY DEVICE

(71) Applicant: Nicoventures Trading Limited, London (GB)

(72) Inventors: Joseph Sutton, London (GB); Terry Lee Angell, London (GB); Martin Conrad Mullin, London (GB)

(73) Assignee: Nicoventures Trading Limited, London (GB)

( * ) Notice: Subject to any disclaimer, the term of this patent is extended or adjusted under 35 U.S.C. 154(b) by 880 days.

(21) Appl. No.: 17/769,574

(22) PCT Filed: Oct. 15, 2020

(86) PCT No.: PCT/GB2020/052592
§ 371 (c)(1),
(2) Date: Apr. 15, 2022

(87) PCT Pub. No.: WO2021/074624
PCT Pub. Date: Apr. 22, 2021

(65) Prior Publication Data

US 2024/0122256 A1 Apr. 18, 2024

(30) Foreign Application Priority Data

Oct. 16, 2019 (GB) ..... 1914979

(51) Int. Cl.
*A24F 40/50* (2020.01)
*A24F 40/46* (2020.01)

(52) U.S. Cl.
CPC ..... *A24F 40/50* (2020.01); *A24F 40/46* (2020.01)

(58) Field of Classification Search
None
See application file for complete search history.

(56) References Cited

U.S. PATENT DOCUMENTS

| | | | | |
|---|---|---|---|---|
| 4,947,875 | A | 8/1990 | Brooks et al. | |
| 5,224,498 | A * | 7/1993 | Deevi | A24F 40/46 131/194 |
| 2014/0270727 | A1* | 9/2014 | Ampolini | F24H 9/0005 392/394 |

(Continued)

FOREIGN PATENT DOCUMENTS

| | | | |
|---|---|---|---|
| CA | 3079154 | | 4/2019 |
| EP | 2460423 | A1 | 6/2012 |
| WO | WO-2014134813 | A1 | 9/2014 |

OTHER PUBLICATIONS

"Office Action received for Canadian Application No. 3154840, mailed on Jun. 20, 2024", 7 pages.

(Continued)

*Primary Examiner* — Frank J Vineis
*Assistant Examiner* — Laura B Figg
(74) *Attorney, Agent, or Firm* — Merchant & Gould P.C.

(57) ABSTRACT

There is provided an aerosol delivery device including a power source and controller, the controller being configured to control delivery of power from the power source to an aerosol-generator during a single aerosol-generation event according to a first power delivery profile and a subsequent power delivery profile having a different profile to the first power delivery profile, wherein the first power delivery profile has a predetermined output based on the voltage of the power supply.

14 Claims, 5 Drawing Sheets

(56) References Cited

U.S. PATENT DOCUMENTS

| | | | |
|---|---|---|---|
| 2017/0215485 | A1 | 8/2017 | Zitzke |
| 2018/0325182 | A1 | 11/2018 | Zitzke et al. |
| 2019/0174266 | A1 | 6/2019 | Baker et al. |
| 2019/0216136 | A1 | 7/2019 | Capuano |
| 2019/0216137 | A1 | 7/2019 | Liu |

OTHER PUBLICATIONS

Coresta, "E-Cigarette Task Force," Technical Report, 2014 Electronic Cigarette Aerosol Parameters, Mar. 2015, 89 pages.
International Preliminary Report on Patentability for Application No. PCT/GB2020/052592, mailed on Jan. 20, 2022, 8 pages.
International Search Report and Written Opinion for Application No. PCT/GB2020/052592, mailed on Jan. 14, 2021, 12 pages.
Second Written Opinion for the Application No. PCT/GB2020/052592, mailed on Aug. 26, 2021, 6 pages.
Canadian Patent Application No. 3154840, Office Action, mailed Jul. 2, 2025, 9 pages.
European Communication dated Aug. 12, 2026 in Application No. 20793781.4.

* cited by examiner

AEROSOL DELIVERY DEVICE

PRIORITY CLAIM

The present application is a National Phase entry of PCT Application No. PCT/GB2020/052592, filed Oct. 15, 2020, which claims priority from GB Application No. 1914979.8, filed Oct. 16, 2019, each of which is hereby fully incorporated herein by reference.

TECHNICAL FIELD

The present disclosure relates to an aerosol delivery device, a system comprising the device, and a method for controlling the device and system.

BACKGROUND

Aerosol delivery systems which generate an aerosol for inhalation by a user are known in the art. Such systems typically comprise an aerosol delivery device and an aerosol-generator, which is capable of converting an aerosolizable material into an aerosol. In some instances, the aerosol generated is a condensation aerosol whereby an aerosolizable material is heated to form a vapor, which is then allowed to condense into an aerosol. In other instances, the aerosol generated is an aerosol, which results from the atomization of the aerosolizable material. Such atomization may be brought about mechanically, e.g., by subjecting the aerosolizable material to vibrations so as to form small particles of material that are entrained in airflow. Alternatively, such atomization may be brought about electrostatically, or in other ways, such as by using pressure etc.

Aerosol delivery systems, such as e-cigarettes, are generally activated via an activation mechanism on or in the aerosol delivery device of the system. Typically, the user will either press a button on a part of the device, or the device (or other part of the system) will include a sensor which determines that aerosol-generation should commence, e.g., the device may include an airflow sensor which senses airflow through the device.

It is important to ensure that aerosol-generation is in line with the expectations of the user, since if aerosol is not produced in a manner which the user expects, the user may perceive the system to be malfunctioning.

It would thus be desirable to provide an aerosolizable material that is formulated so as to be acceptable to a user.

SUMMARY

In one aspect there is provided an aerosol delivery device comprising a power source and controller, the controller being configured to control delivery of power from the power source to an aerosol-generator during a single aerosol-generation event according to a first power delivery profile and a subsequent power delivery profile having a different profile to the first power delivery profile, wherein the first power delivery profile has a predetermined output based on the voltage of the power supply.

In this regard, in some circumstances it has been found that controlling power supply to the aerosol-generator such that there is a first power delivery profile and a subsequent power delivery profile can allow for the aerosol-generation to match the expectations of the user. In particular, power to an aerosol-generator may be controlled so as to ensure that a specific power profile is delivered to the aerosol-generator. This particular power profile in turn leads to a specific aerosol profile. For example, and where issues relating to supply of aerosolizable material are not present, the power supplied to the aerosol-generator will generally be proportional to the rate at which aerosol is produced. However, since many aerosol delivery systems utilize a power source, such as a battery, which has a finite (but rechargeable) amount of power, it is not always possible to provide a consistent power to the aerosol-generator throughout the discharge cycle of the power source. Indeed, as the voltage of the power source reduces, so does the power delivery (since P=IV). This can mean that the amount of power supplied when the power source is fully charged can be greater than the amount of power supplied when the power source has become depleted. To address this issue, some aerosol provision systems utilize a power control system. Such power control systems provide a normalized power over a range of voltages. One such example of a power control system is referred to as "pulse width modulation" or PWM. When a PWM control system is implemented, the controller is configured to partition the delivery of power to the aerosol-generator into phases, i.e. "on" phases and "off" phases. The duration of both the "on" phase and the "off" phase can be controlled so as to deliver a desired power profile.

Most aerosol delivery systems utilize such a power control method throughout the entirety of the power delivery to the aerosol-generator. This may have negative consequences, however, since employing such a power control method to provide a consistent power delivery profile necessarily involves delivering less power than the maximum power available. This can have a negative impact on the aerosol profile as perceived by the user. In particular, where the device is providing power to an aerosol-generating component which comprises a heater, the rate at which the temperature of the heater increases from ambient to the required temperature will be dependent on the power supplied to it. If the rate is slow, then the time for an aerosol to be generated will also be slow. This can be of particular concern to users when they are relying on a system activated by inhalation, since the first percentage of an inhalation may contain less aerosol. Thus, by allowing less power to be supplied to the aerosol-generating component (so as to ensure a consistent overall delivery), the result can in fact be less consistent aerosol-generation.

In order to mitigate this, it has been suggested that power delivered during an initial part of an inhalation is maximized, so that the rate of temperature increase for the heater will be as great as possible. Once the required temperature has been achieved, it is possible to then revert to a power control system, which has an overall aim of providing consistent power delivery.

The Applicant has found that even this proposal to use maximum power during an initial phase of aerosol-generation, and then revert to a "controlled" profile thereafter, suffers from drawbacks. In particular, the initial phase whereby maximum power is delivered is also subject to inconsistency resulting from changes in the power source. The Applicant has found that by ensuring that the first power delivery profile has a predetermined power output based on the voltage of the power supply, a consistent power delivery during this initial phase can be achieved. This means that the user experiences consistency in respect of both commencement of aerosol-generation and maintenance of aerosol delivery.

In a further aspect there is provided an aerosol delivery system comprising an aerosol delivery device as defined herein and an article as defined herein. The aerosol delivery system generally comprises an aerosol-generating component, which may form part of the article or the aerosol delivery device In a further aspect there is provided a method of controlling an aerosol delivery system, the method comprising:

providing an aerosol delivery device comprising a power source and controller, the controller being configured to control delivery of power from the power source to an aerosol-generator, wherein the controller delivers power to the aerosol-generating component during a single aerosol-generation event according to a first power delivery profile and a subsequent power delivery profile having a different profile to the first power delivery profile, wherein the first power delivery profile has a predetermined output based on the voltage of the power supply.

These aspects and other aspects will be apparent from the following detailed description. In this regard, particular sections of the description are not to be read in isolation from other sections.

DETAILED DESCRIPTION OF THE DRAWINGS

As described above, the present disclosure relates to an aerosol delivery device, which may form, or be used with, an aerosol delivery system, such as an e-cigarette.

Figure 1:
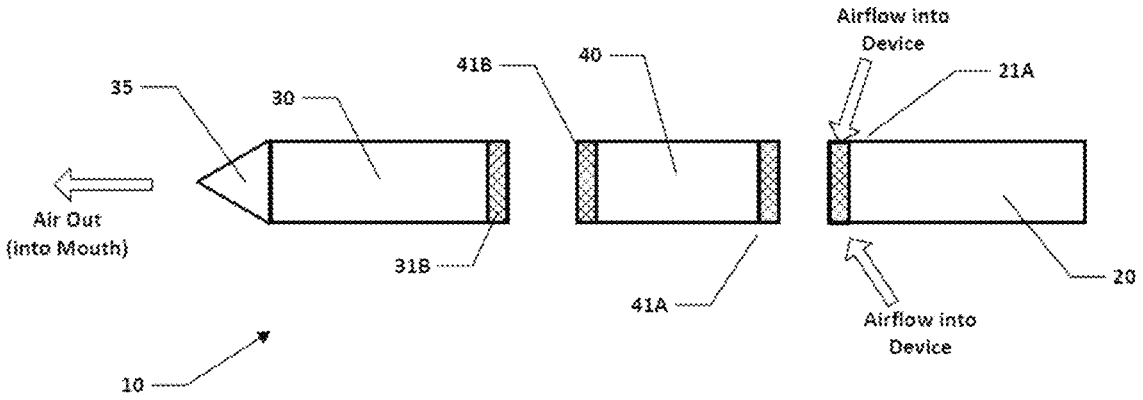
FIG. 1 is a schematic (exploded) diagram of an e-cigarette in accordance with some embodiments of the disclosure.

FIG. 1 is a schematic (exploded) diagram of an aerosol delivery system 10 in accordance with some embodiments of the disclosure (not to scale). The aerosol delivery system comprises an aerosol delivery device 20, an article 30 and an aerosol-generating component 40. The article includes an internal chamber containing a reservoir of aerosolizable material (such as a nicotine containing formulation) and a mouthpiece 35. The article reservoir may be a foam matrix or any other structure for retaining the aerosolizable material until such time that it is required to be delivered to the vaporizer. It is also possible that the reservoir does not contain such a matrix and the aerosolizable material is held freely in the reservoir.

The aerosol delivery device 20 includes a re-chargeable power source (cell or battery) to provide power to aerosol delivery system 10 and a controller (circuit board) for generally controlling aerosol delivery system. The vaporizer 40 includes an aerosol-generating component (heater) for vaporizing the aerosolizable material and further includes a wick or similar device which transports a small amount of aerosolizable material from the reservoir in the article to a heating location on or adjacent the aerosol-generating component. When the aerosol-generating component receives power from the battery, as controlled by the circuit board, the aerosol-generating component vaporizes the aerosolizable material from the wick and this vapor is then inhaled by a user through the mouthpiece.

The aerosol delivery device 20 and the vaporizer 40 are detachable from one another, but are joined together when the device 10 is in use, for example, by a screw or bayonet fitting (indicated schematically in FIG. 1 as 41A and 21A). The connection between the aerosol delivery device and vaporizer provides for mechanical and electrical connectivity between the two. When the aerosol delivery device is detached from the vaporizer, the electrical connection 21A on the aerosol delivery device that is used to connect to the vaporizer can serve as a socket for connecting a charging device (not shown). The other end of the charging device can be plugged into a USB socket to re-charge the cell in the body of the e-cigarette. In other implementations, the aerosol delivery device may be provided with a cable for direct connection between the electrical connection 21A and a USB socket. In other implementations, the aerosol delivery device may be provided with a USB socket for connecting to a suitable USB cable (micro, mini, USB-C, etc.).

The aerosol delivery device is provided with one or more holes (not shown in FIG. 1) for air inlet. These holes connect to an air passage through the aerosol delivery device to an air outlet provided as part of connector 21A. This then links to an air path through the vaporizer 40 and the article 30 to the mouthpiece 35. The article 30 and the vaporizer 40 are attached in use by connectors 41B and 31B (again shown schematically in FIG. 1). Alternatively, the vaporizer 40 may be integrated within the article 30 such that aerosolizable material is transferred to the heater from the reservoir.

As explained above, the article includes a chamber containing a reservoir for aerosolizable material, and a mouthpiece. When a user inhales through the mouthpiece 35, air is drawn into the aerosol delivery device 20 through one or more air inlet holes. This airflow (or the resulting change in pressure) is detected by a pressure sensor, which in turn activates the heater to vaporize the aerosolizable material from the article. The airflow passes from the aerosol delivery device, through the vaporizer, where it combines with the vapor produced from the aerosolizable material to form an aerosol, and this aerosol then passes through the cartridge and out of the mouthpiece 35 to be inhaled by a user. The article 30 may be detached from the vaporizer 40 and disposed of when the supply of aerosolizable material is exhausted (and then replaced with another cartridge). Alternatively, the reservoir could be refilled with aerosolizable material.

It will be appreciated that the aerosol delivery system 10 shown in FIG. 1 is presented by way of example, and various other implementations can be adopted. For example, as explained above, in some embodiments, the article 30 and the vaporizer 40 may be provided as a single unit, and the charging facility may connect to an additional or alternative power source, such as a car cigarette lighter.

Figure 2:
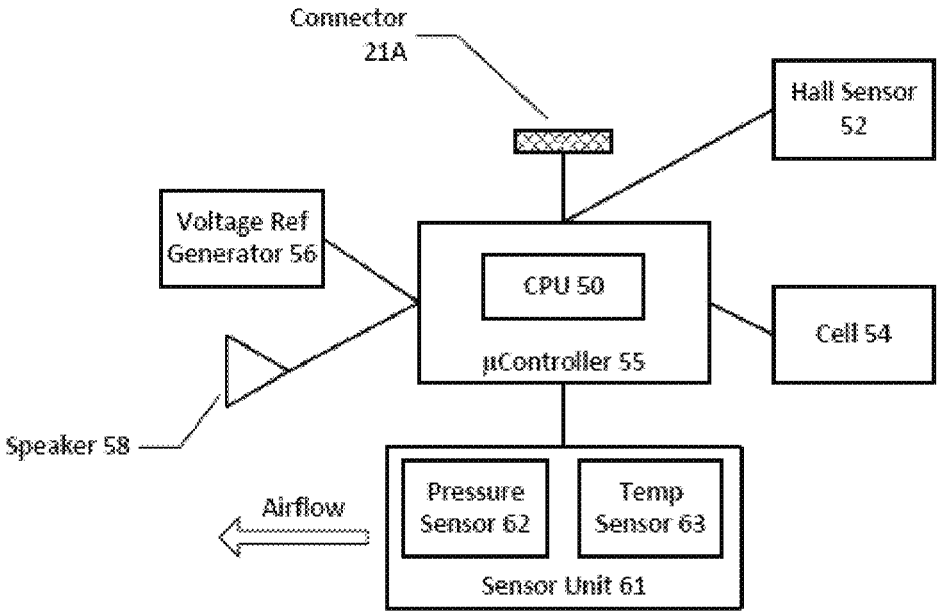
FIG. 2 is a schematic diagram of the main functional components of the body of the e-cigarette of FIG. 1 in accordance with some embodiments of the disclosure.

FIG. 2 is a schematic diagram of the main functional components of the aerosol delivery device 20 of the aerosol delivery system 10 of FIG. 1 in accordance with some embodiments of the disclosure. These components may be mounted on the circuit board provided within the aerosol delivery device 20, although depending on the particular configuration, in some embodiments, one or more of the components may instead be accommodated in the body to operate in conjunction with the circuit board, but is/are not physically mounted on the circuit board itself.

The aerosol delivery device 20 includes a sensor unit 60 located in or adjacent to the air path through the aerosol delivery device 20 from the air inlet to the air outlet (to the vaporizer). The sensor unit includes a pressure sensor 62 and optionally a temperature sensor 63 (also in or adjacent to this air path). The aerosol delivery device further includes a Hall effect sensor 52, a voltage reference generator 56, an optional speaker 58, and an electrical socket or connector 21A for connecting to the vaporizer 40 or to a USB charging device. One or more LEDs (not shown) may also be present on the device to provide indication to the user concerning battery and operational status. It may also be possible to charge the aerosol delivery device 20 wirelessly.

The microcontroller 55 includes a CPU 50. The operations of the CPU 50 and other electronic components, such as the pressure sensor 62, are generally controlled at least in part by software programs running on the CPU (or other component). Such software programs may be stored in non-volatile memory, such as ROM, which can be integrated into the microcontroller 55 itself, or provided as a separate component. The CPU may access the ROM to load and execute individual software programs as and when required. The microcontroller 55 also contains appropriate communications interfaces (and control software) for communicating as appropriate with other devices in the aerosol delivery device 10, such as the pressure sensor 62.

The CPU controls the optional speaker 58/LEDs to produce outputs to reflect conditions or states within the aerosol delivery device, such as a low battery warning. Different signals for signaling different states or conditions may be provided by utilizing tones or beeps of different pitch and/or duration, and/or by providing multiple such beeps or tones.

As noted above, the aerosol delivery system 10 provides an air path from the air inlet through the aerosol delivery device 20, past the pressure sensor 62 and the heater (in the vaporizer), to the mouthpiece 35. Thus, when a user inhales on the mouthpiece of the aerosol delivery system, the CPU 50 detects such inhalation based on information from the pressure sensor. In response to such a detection, the CPU supplies power from the battery or cell 54 to the heater, which thereby heats and vaporizes the aerosolizable material from the wick for inhalation by the user.

According to one aspect, the controller is configured to control delivery of power from the power source to an aerosol-generator during a single aerosol-generation event according to a first power delivery profile and a subsequent power delivery profile having a different profile to the first power delivery profile, wherein the first power delivery profile has a predetermined output based on the voltage of the power supply.

It will be appreciated that a "single aerosol-generation event" refers to an instance of aerosol-generation corresponding to a single inhalation on the device by a user.

In some embodiments, the predetermined power output may be dependent on the type of aerosol-generating component being used. In some embodiments, the aerosol-generating component comprises a heater, such as an electrically resistive (ohmic) heater, a microwave heater, or an inductively heated heater (whereby the heater forms the susceptor). In some embodiments, the heater can be formed from any suitable material, such as stainless steel, or heat conducting alloys such as NiCr alloys.

The configuration of the heater may influence the predetermined power output of the first power delivery profile. In some embodiments, the heater is a wire. In some embodiments, the heater is a sheet of material. The sheet of material may be porous. The sheet of material may be made of a homogenous, granular, fibrous or flocculent sintered metal(s) so as to form said capillary structure. In some embodiments, heater elements can be made from a conductive material, which is a non-woven sintered porous web structure comprising metal fibers, such as fibers of stainless steel. For example, the stainless steel may be AISI (American Iron and Steel Institute) 316L (corresponding to European standard 1.4404). The material's weight may be in the range of 100-300 g/m2.

The thickness or diameter of the heater may be 600 μm or less, such as 300 μm or less, such as 200 μm or less.

The heater of the aerosol-generating component may have an ohmic resistance within a specific range, since the ohmic resistance of the heater may influence the power drawn from the power source. In some embodiments, the heater has an average resistance (rather than a local resistance at any particular point) of 0.1 to 2 Ohms. In some embodiments, the heater has an average resistance of 0.1 to 1.9 Ohms. In some embodiments, the heater has an average resistance of 0.1 to 1.8 Ohms. In some embodiments, the heater has an average resistance of 0.1 to 1.7 Ohms. In some embodiments, the heater has an average resistance of 0.1 to 1.6 Ohms. In some embodiments, the heater has an average resistance of 0.1 to 1.5 Ohms. In some embodiments, the heater has an average resistance of 0.1 to 1.4 Ohms. In some embodiments, the heater has an average resistance of 0.1 to 1.3 Ohms. In some embodiments, the heater has an average resistance of 0.1 to 1.2 Ohms. In some embodiments, the heater has an average resistance of 0.1 to 1.1 Ohms. In some embodiments, the heater has an average resistance of 0.1 to 1.0 Ohms. In some embodiments, the heater has an average resistance of 0.2 to 2.0 Ohms. In some embodiments, the heater has an average resistance of 0.3 to 2.0 Ohms. In some embodiments, the heater has an average resistance of 0.4 to 2.0 Ohms. In some embodiments, the heater has an average resistance of 0.5 to 2.0 Ohms. In some embodiments, the heater has an average resistance of 0.6 to 2.0 Ohms. In some embodiments, the heater has an average resistance of 0.7 to 2.0 Ohms. In some embodiments, the heater has an average resistance of 0.8 to 2.0 Ohms. In some embodiments, the heater has an average resistance of 0.9 to 2.0 Ohms.

As described above, the heater of the aerosol-generating component is generally coupled with a transport system for transporting aerosolizable material (source liquid) to the heater. In some embodiments, the transport system may be selected from a wick, pump, sprayer or the like.

Where the transport system comprises a wick, the wick may be formed a sintered material, a fibrous material (such as cotton, or metallic fibers), or a foamed material. The sintered material may comprise sintered ceramic, sintered metal fibers/powders, or a combination of the two. Typically, a single wick will be present, but it is envisaged that more than one wick could be present, for example, two, three, four or five wicks.

The (or at least one of/all of the) sintered wick(s) may have deposited thereon/embedded therein an electrically resistive heater. As described above, such a heater may be formed from heat conducting alloys such as NiCr or NiFe alloys. Alternatively, the sintered material may have such electrical properties such that when a current is passed there through, it is heated. Thus, the aerosol-generating component and the wick may be considered to be integrated. In some embodiments, the aerosol-generating component and the wick are formed from the same material and form a single component.

In some embodiments, the wick is formed from a sintered metal material and is generally in the form of a planar sheet. Thus, the wick element may have a substantially thin flat shape. For example, it may be considered as a sheet, layer, film, substrate or the like. By this it is meant that a thickness of the wick is less or very much less than at least one of the length and the width of the wick. Thus, the wick thickness (its smallest dimension) is less or very much less than the longest dimension.

The wick may be made of a homogenous, granular, fibrous or flocculent sintered metal(s) so as to form said capillary structure. Wick elements can be made from a conductive material, which is a nonwoven sintered porous web structure comprising metal fibers, such as fibers of stainless steel. For example, the stainless steel may be AISI (American Iron and Steel Institute) 316L (corresponding to European standard 1.4404). The material's weight may be in the range of 100-300 $g/m^2$.

In some embodiments, the predetermined output is within a predefined energy range, for example from 12J to 1J. In some embodiments, the predefined energy range is from 12J to 1J. In some embodiments, the predefined energy range is from 11J to 1J. In some embodiments, the predefined energy range is from 10J to 1J. In some embodiments, the predefined energy range is from 9J to 1J. In some embodiments, the predefined energy range is from 8J to 1J. In some embodiments, the predefined energy range is from 7J to 1J. In some embodiments, the predefined energy range is from 6J to 1J. In some embodiments, the predefined energy range is from 12J to 2J. In some embodiments, the predefined energy range is from 12J to 3J. In some embodiments, the predefined energy range is from 12J to 4J. In some embodiments, the predefined energy range is from 12J to 5J. In some embodiments, the predefined energy range is from 12J to 6J.

In some embodiments, the predetermined power output is based on predefined power delivery duration. For example, in some embodiments the first power delivery profile has a duration of 100 ms to 900 ms. In some embodiments, the first power delivery profile has a duration of 100 ms to 900 ms. In some embodiments, the first power delivery profile has a duration of 100 ms to 800 ms. In some embodiments, the first power delivery profile has a duration of 100 ms to 700 ms. In some embodiments, the first power delivery profile has a duration of 100 ms to 600 ms. In some embodiments, the first power delivery profile has a duration of 100 ms to 500 ms. In some embodiments, the first power delivery profile has a duration of 200 ms to 900 ms. In some embodiments, the first power delivery profile has a duration of 300 ms to 900 ms. In some embodiments, the first power delivery profile has a duration of 400 ms to 900 ms.

The predetermined power output is generally selected so as to provide an initial aerosol formation and/or maximum aerosol density, for a given inhalation profile as quickly as possible. In this regard, a given inhalation profile may be a "55/3/30" puff regime, which refers to 55 mL air being drawn in 3 s, every 30 seconds. This inhalation profile has been recognized in the art as providing a consistent inhalation regime (see Coresta, E-Cigarette Task Force, Technical Report, 2014 Electronic Cigarette Aerosol Parameters, Updated March 2015). Maximum aerosol density can be determined based on the percentage transmission of light through the aerosol, and can be determined using a Spraytec Analyser from Malvern Panalytical.

In some embodiments, when air is drawn past the aerosol-generating component according to a 55/3/30 regime, the predetermined power output is based on the time to initial aerosol formation being less than 0.8s, such as less than 0.7s, such as less than 0.6s, such as less than 0.5s, such as less than 0.4s.

In some embodiments, when air is drawn past the aerosol-generating component according to a 55/3/30 regime, the predetermined power output is based on the time to maximum aerosol density being less than 2s, such as less than 1.9s, such as less than 1.8s, such as less than 1.7s, such as less than 1.6s, such as less than 1.5s.

By ensuring that the predetermined power output during the first power delivery profile results in aerosol-generation in accordance with the above times to initial aerosol formation and/or maximum aerosol density, the user is provided with an improved experience since the experience of aerosol-generation is aligned with the expectations of aerosol-generation. When the predetermined power output during the first power delivery profile results in a time to initial aerosol formation and/or maximum aerosol density which is outside the above times, then the user may perceive that the device is malfunctioning or inferior since aerosol is not generated when they expected it.

In some embodiments, the predetermined power output is delivered in accordance with a pre-defined pulse width modulation cycle. In this regard, and as illustrated in FIG. 2, the aerosol delivery system 10 of FIGS. 1 and 2 is powered by a re-chargeable cell 54. In practice, the voltage output of such cells tends to decline as they discharge, for example, from about 4.2V when fully charged, down to about 3.0 to 3.3V just before being fully discharged depending on the hardware/firmware settings of the system. Since the power output across a given heating resistor R goes with V 2/R, this implies that there would generally be a corresponding drop in power output such that the final operational power output (assuming a final voltage of 3.6V) is only 73% of the initial power output (at a voltage of 4.2V). This change in power supplied by the cell 54 to the heater in the vaporizer 40 may impact the rate at which the temperature reaches the required temperature during the first power delivery profile.

Figure 3:
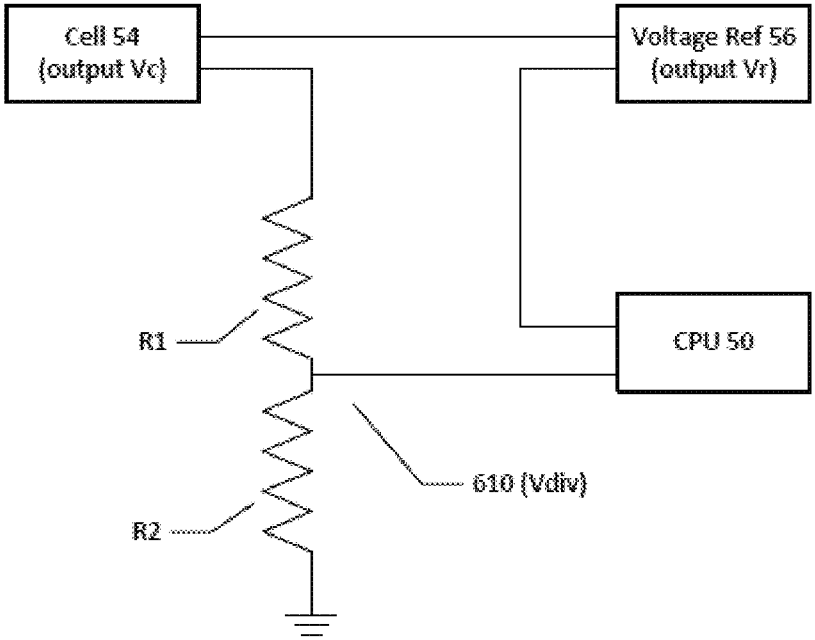
FIG. 3 is a schematic diagram of the power regulation system within the e-cigarette of FIGS. 1 and 2 in accordance with some embodiments of the disclosure.

FIG. 3 is a schematic depiction of a part of the power regulation system for the aerosol delivery system of FIGS. 1 and 2 in accordance with some embodiments of the disclosure. The power regulation system includes a voltage reference device 56, which provides a consistent (known) output voltage level (Vr), irrespective of variations in the output voltage (Vc) of the re-chargeable cell 54. The power regulation system further comprises a voltage divider comprising two resistors, R1, R2, which receives and divides the output voltage (Vc) in known fashion in accordance with the relative size (resistance) of resistors R1 and R2. The mid-point of the voltage divider 610 is used to take an output voltage (Vdiv).

The CPU 50 receives the voltage Vdiv from the voltage divider and the reference voltage (Vr) from the voltage reference device 56. The CPU compares these two voltages and based on Vr is able to determine Vdiv. Furthermore, assuming that the (relative) resistances of R1 and R2 are known, the CPU is further able to determine the cell output voltage (Vc) from Vdiv. This therefore allows the CPU to measure (track) the variation in voltage output (Vc) from the cell 54 as the cell discharges.

FIG. 3 illustrates how in some embodiments of the disclosure, the power regulation system of the aerosol delivery system 10 uses a form of pulse-width modulation to compensate for the variation in voltage. Thus, rather than the CPU 50 providing continuous electrical power to the aerosol-generating component (heater) in the vaporizer 40, the electrical power is supplied instead as a series of pulses at regular intervals, in effect, as a rectangular or square wave. Assuming that each pulse has an "on" duration of Dp, and a pulse is supplied every period of Di (referred to as the pulse interval or interval duration), then the ratio of the pulse duration to the interval duration, Dp/Di, is known as the duty cycle. If Dp=Di then the duty cycle is one (or 100%), and the CPU in effect provides a continuous voltage. However, if the duty cycle is less than 1, the CPU alternates periods of providing electrical power with periods of not providing electrical power. For example, if the duty cycle is 65%, then each voltage pulse has a duration representing 65% of the interval duration, and no voltage (or power) is supplied for the remaining 35% of the interval.

If we consider a signal level which provides power P for a duty cycle of 1 (i.e., continuous supply), then the average amount of power provided when the duty cycle is reduced below 1 is given by P multiplied by the duty cycle. Accordingly, if the duty cycle is 65% (for example), then the effective power rate becomes 65% of P.

Figure 4A:
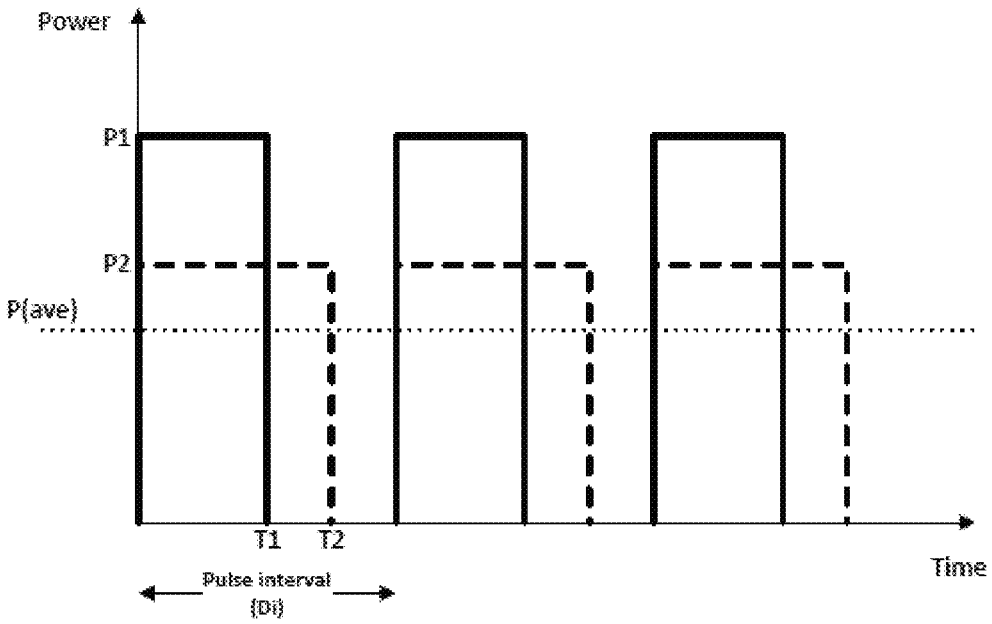
FIG. 4*a* illustrates how the power regulation system of FIG. 3 changes the duty cycle to maintain a constant average power level in accordance with some embodiments of the disclosure.

FIG. 4*a* illustrates two different rectangular waves, one shown in solid line, the other shown in dashed line. The pulse interval or period (Di) is the same for both waves. The output shown in solid line has a pulse duration (width) of T1 and a power output when on, i.e.,k an instantaneous power level, of P1. The duty cycle of this solid line output is T1/Di, to give an average power output of P1xT1/Di. Likewise, the output shown in dashed line has a pulse duration (width) of T2 and an instantaneous power output when on of P2. The duty cycle of this solid line output is T2/Di, to give an average power output of P2xT1/Di. FIG. 4A also indicates in dotted line the average power output (P (ave)), which is the same for both outputs (solid and dashed line). This implies that (P1xT1/Di)=(P2xT1/Di). In other words, assuming that the pulse interval (Di) is maintained constant, then the average power output is constant provided that the pulse duration (T) varies inversely with the (instantaneous) power output (P), so that PxT is also a constant.

In accordance with some embodiments of the disclosure, the predetermined power output ($P_F$) of the first power delivery profile is a pulse-width modulation scheme such as shown in FIG. 4A to provide the vaporizer heater with an approximately constant power level. Further, in accordance with some embodiments of the disclosure, the subsequent power delivery profile has a predetermined power output ($P_S$), wherein the predetermined power output of the subsequent power delivery profile is less than that of the first power delivery profile. For example, it may be that a pulse-width modulation scheme/cycle as described herein is provided in both the first and subsequent power delivery profiles, yet $P_S<P_F$.

In some embodiments, the duty cycle during the first power delivery profile is more than the duty cycle during the subsequent power delivery profile.

In some embodiments, the duty cycle during the first power delivery profile is approximate to the duty cycle during the subsequent power delivery profile. This may particularly be the case where the power source is close to fully depleted. In some embodiments, the duty cycle required during the first power delivery profile is used as an indicator of the state of the power source. In particular, if the duty cycle theoretically required to deliver the first power delivery profile exceeds 1, this is an indication that the voltage of the power source is too low. Thus, this could be used as a trigger to notify the user that the power source needs to be charged. Thus, in some embodiments the required duty cycle for the first power delivery profile is used as an indication of the state of the power source. This ensures that the first power delivery profile is available for implementation. In some embodiments, the duty cycle may be dynamically adjusted during each profile.

This may result from the voltage of the battery reducing during either profile. Thus, the voltage of the battery may be monitored during the first profile, the subsequent profile or both. For example, the duty cycle at the start of the first profile may be less than the duty cycle at the end of that same profile.

In some embodiments, the duty cycle during the first power delivery profile is selected so as to produce an absolute increase in average power output compared to the subsequent power delivery profile. The increase in average power output may be from about 0.5 to 20 W. In some embodiments, the increase in average power output may be from about 0.5 to 15 W. In some embodiments, the increase in average power output may be from about 0.5 to 10 W. In some embodiments, the increase in average power output may be from about 0.5 to 9 W. In some embodiments, the increase in average power output may be from about 0.5 to 8 W. In some embodiments, the increase in average power output may be from about 0.5 to 7 W. In some embodiments, the increase in average power output may be from about 0.5 to 6 W. In some embodiments, the increase in average power output may be from about 0.5 to 5 W. In some embodiments, the increase in average power output may be from about 0.5 to 4 W. In some embodiments, the increase in average power output may be from about 0.5 to 3 W. In some embodiments, the increase in average power output may be from about 0.5 to 2 W. In some embodiments, the increase in average power output may be from about 0.5 to 1 W. In some embodiments, the increase in average power output may be from about 0.6 to 5 W. In some embodiments, the increase in average power output may be from about 0.7 to 5 W. In some embodiments, the increase in average power output may be from about 0.8 to 5 W. In some embodiments, the increase in average power output may be from about 0.9 to 5 W.

In some embodiments, the duty cycle during the first power delivery profile is selected so as to produce a relative increase in average power compared to the subsequent power delivery profile, such that the energy delivered during the first power delivery profile is from 12J to 1J. In some embodiments, the duty cycle during the first power delivery profile is selected so as to produce a relative increase in average power compared to the subsequent power delivery profile, such that the energy delivered during the first power delivery profile is from 12J to 2J. In some embodiments, the duty cycle during the first power delivery profile is selected so as to produce a relative increase in average power compared to the subsequent power delivery profile, such that the energy delivered during the first power delivery profile is from 12J to 3J. In some embodiments, the duty cycle during the first power delivery profile is selected so as to produce a relative increase in average power compared to the subsequent power delivery profile, such that the energy delivered during the first power delivery profile is from 12J to 4J. In some embodiments, the duty cycle during the first power delivery profile is selected so as to produce a relative increase in average power compared to the subsequent power delivery profile, such that the energy delivered during the first power delivery profile is from 11J to 1J. In some embodiments, the duty cycle during the first power delivery profile is selected so as to produce a relative increase in average power compared to the subsequent power delivery profile, such that the energy delivered during the first power delivery profile is from 10J to 1J. In some embodiments, the duty cycle during the first power delivery profile is selected so as to produce a relative increase in average power compared to the subsequent power delivery profile, such that the energy delivered during the first power delivery profile is from 9J to 1J. In some embodiments, the duty cycle during the first power delivery profile is selected so as to produce a relative increase in average power compared to the subsequent power delivery profile, such that the energy delivered during the first power delivery profile is from 8J to 1J.

In some embodiments, the predetermined power output of the first power delivery profile is selected so as to provide from 5 to 50% of the total energy delivered during both the first and subsequent power delivery profiles. In some embodiments, the predetermined power output of the first power delivery profile is selected so as to provide from 5 to 45% of the total energy delivered during both the first and subsequent power delivery profiles. In some embodiments, the predetermined power output of the first power delivery profile is selected so as to provide from 5 to 40% of the total energy delivered during both the first and subsequent power delivery profiles. In some embodiments, the predetermined power output of the first power delivery profile is selected so as to provide from 5 to 30% of the total energy delivered during both the first and subsequent power delivery profiles. In some embodiments, the predetermined power output of the first power delivery profile is selected so as to provide from 5 to 25% of the total energy delivered during both the first and subsequent power delivery profiles. In some embodiments, the predetermined power output of the first power delivery profile is selected so as to provide from 5 to 20% of the total energy delivered during both the first and subsequent power delivery profiles. In some embodiments, the predetermined power output of the first power delivery profile is selected so as to provide from 10 to 50% of the total energy delivered during both the first and subsequent power delivery profiles. In some embodiments, the predetermined power output of the first power delivery profile is selected so as to provide from 15 to 50% of the total energy delivered during both the first and subsequent power delivery profiles. In some embodiments, the predetermined power output of the first power delivery profile is selected so as to provide from 20 to 50% of the total energy delivered during both the first and subsequent power delivery profiles.

Thus, the power regulation system of FIG. 3 allows the CPU 50 to track the current voltage output level from the cell 54. Based on this measured voltage output level, the CPU then sets an appropriate duty cycle for controlling power to the vaporizer heater to compensate for variations in the voltage output level from the cell 54, thereby providing the vaporizer heater with an approximately constant (average) power level during the first power delivery profile.

Note that the pulse interval is chosen to be sufficiently short (typically <<1 second) such that it is much smaller than the thermal response time of the heater. In other words, the "off" portions of each pulse are short enough that the heater does not cool significantly during this period. Therefore, the heater provides in effect a constant heat source for vaporizing the nicotine, based on the average received power level, with no significant modulation in heat output at the timescale of individual pulse intervals.

Figure 4B:
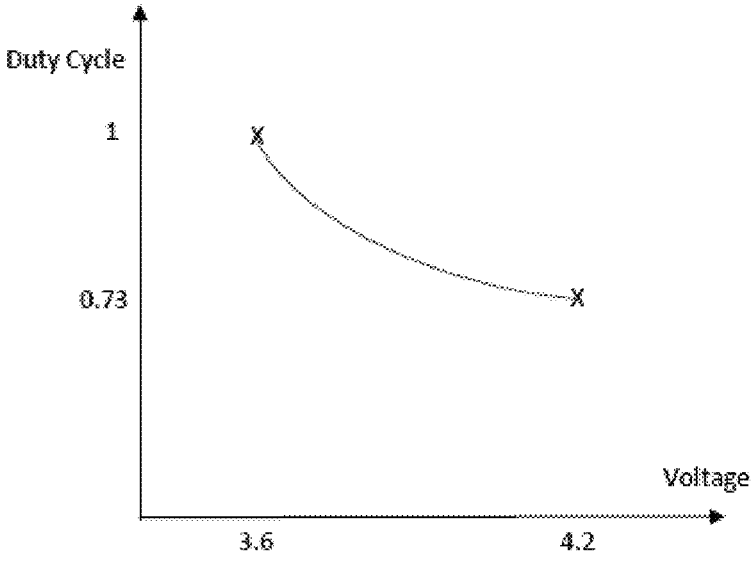
FIG. 4*b* is a schematic graph showing the variation of duty cycle in relation to the measured or tracked voltage of the cell in accordance with some embodiments of the disclosure.

FIG. 4*b* illustrates in schematic form the mapping from the (measured) voltage output level to duty cycle. When the cell 54 provides its lowest output voltage (3.6V), the duty cycle may be set to 1 (the maximum possible value) in order to ensure that the appropriate time to initial aerosol formation and/or maximum aerosol density is achieved.

When the cell 54 provides its highest output voltage (4.2V), it may be that the duty cycle for the subsequent power delivery profile is set to −0.73. This ensures that consistent amounts of aerosol are generated throughout the inhalation. Accordingly, the duty cycle for the subsequent power delivery profile is generally set between −0.73 and 1 so as ensure that the appropriate time to initial aerosol formation and/or maximum aerosol density is achieved.

FIG. 4*b* also illustrates schematically the duty cycle for intervening voltages, such that the duty cycle (equivalent to pulse duration for a fixed pulse interval) varies inversely with power output (which is proportional to V 2 for a fixed heater resistance). It will be appreciated that the precise variation of duty cycle with voltage shown in FIG. 4*b* is by way of example only, and may vary according to the details of any given implementation. For any given system, the variation can be empirically determined and stored within the system such that the appropriate power levels can be chosen in accordance with the empirically derived values for time to initial aerosol formation and/or maximum aerosol density.

Figure 5A:
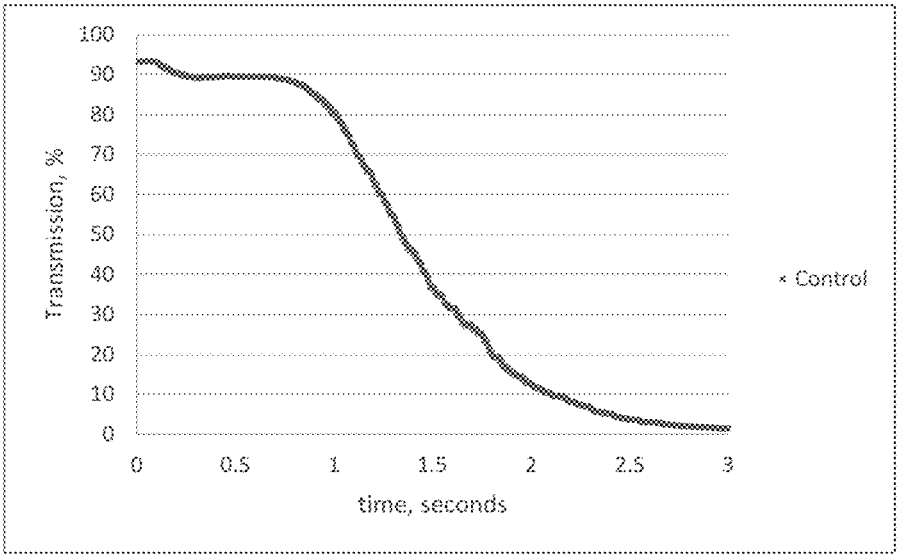
FIG. 5*a* provides a trace graph for a light transmission test conducted on an aerosol generated using an aerosol delivery device not in accordance with the present disclosure.
Figure 5B:
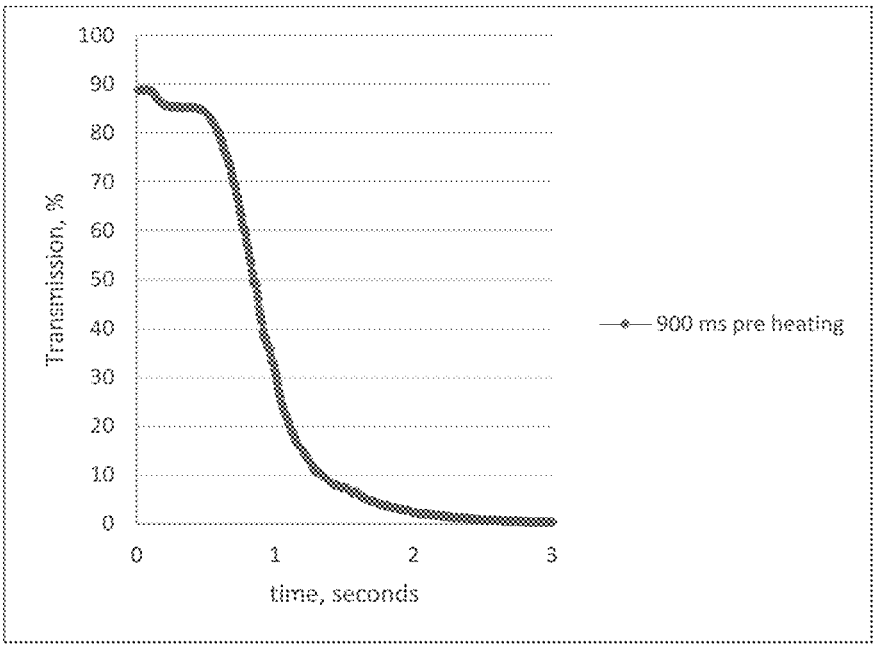
FIG. 5*b* provides a trace graph for a light transmission test conducted on an aerosol generated using an aerosol delivery device in accordance with the present disclosure.
Figure 6:
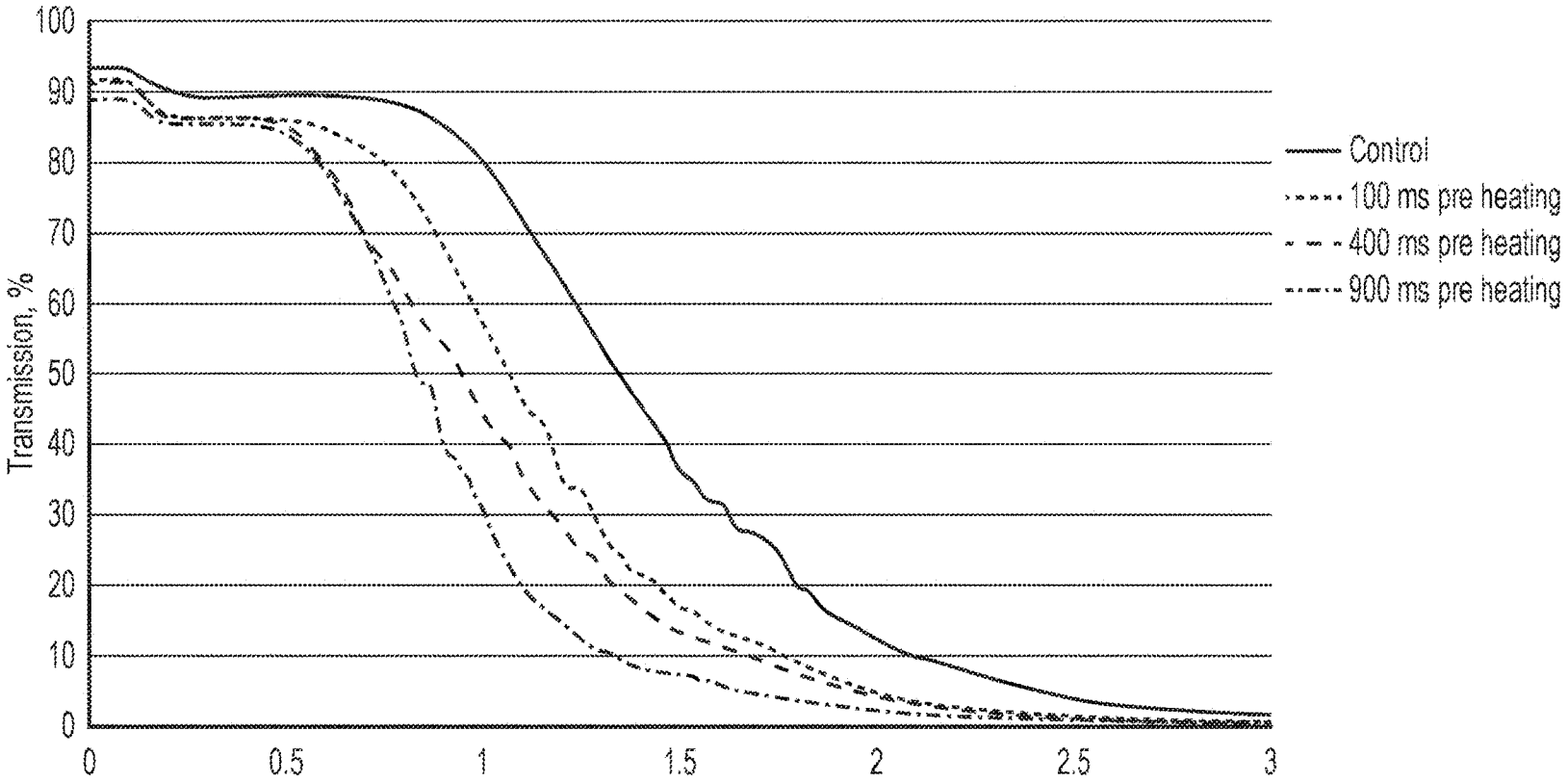
FIG. 6 provide trace graphs for light transmission tests conducted on aerosols generated using an aerosol delivery device in accordance with the present disclosure.

In this regard, reference is made to FIGS. 5*a* and 5*b*, Table 1 and FIG. 6.

Table 1 provides time to initial aerosol formation and time to maximum aerosol density for a range of aerosol delivery systems where the power delivery to the aerosol-generating component was varied.

The control aerosol delivery system was provided with a power profile consistent with a pulse width modulation control system, whereby the power delivery was approximately 6.5 W over the 3*s* puff (delivering 19.5 J per puff) (FIG. 5*a*).

The aerosol delivery systems configured according to the present disclosure were provided with a power profile consistent with the present disclosure. In particular, they were provided with power profiles in the range of about 13 W to about 9 W over the 3*s* puff for 100 ms, 400 ms (FIG. 6) and 900 ms (FIG. 5*b*) respectively.

The aerosol delivery system contained a wire coil heater of operating resistance 1.4 Ohms (+/−0.1 Ohms), wrapped around a wick which was coupled with a store of liquid material to be aerosolized. Air was drawn past the heater and wick according to a "55/3/30" regime as outlined above.

The time to initial aerosol formation and time to maximum aerosol density for the system was measured by light transmission on a SprayTec laser diffraction system (model STPS311, available from Malvern Panalytical). Time to initial aerosol formation was approximately determined based on the initial decrease in light transmission (as noted in the figures). Time to maximum aerosol density was approximately determined based on the final flat part of the trace showing no further decrease in light transmission (as noted in the figures).

FIGS. 5*a* and 5*b* provide the traces for the control and test at 900 ms respectively. Table 1 below provides a summary of the results.

TABLE 1

| Sample | Power | Time to Aerosol Formation (s) | Time to Max Density of Aerosol (s) |
|---|---|---|---|
| Control (single PWM power profile for entire puff) | Approx. 6.5 W | ~0.8 | ~2 |
| First power delivery profile duration - 900 ms | 12.4-9.09 W* | ~0.4 | ~1.3 |

*Power supplied at constant voltage and thus slight power variations owing to resistance change of heater As can be derived from FIGS. 5*a* and 5*b*, and also from Table 1, installing a first power delivery profile whereby the power is uplifted by approximately 5 W led to a decrease in both time to initial aerosol formation and time to maximum aerosol density.

A second set of tests was carried out using the same system as above, but with the inclusion of additional durations of 100 ms and 400 ms. The results are shown in FIG. 6. As can be seen, installing a first power delivery profile whereby the power is uplifted by approximately 5 W led to a step wise decrease in both time to initial aerosol formation and time to maximum aerosol density. This further shows that as the energy delivered increases (since the same power is applied for longer) the time to initial aerosol formation and time to maximum aerosol density are both reduced.

The various embodiments described herein are presented only to assist in understanding and teaching the disclosed features. These embodiments are provided as a representative sample of embodiments only, and are not exhaustive and/or exclusive. It is to be understood that advantages, embodiments, examples, functions, features, structures, and/or other aspects described herein are not to be considered limitations on the scope of the disclosure, and that other embodiments may be utilized and modifications may be made without departing from the scope of the disclosure. Various embodiments of the disclosure may suitably comprise, consist of, or consist essentially of, appropriate combinations of the disclosed elements, components, features, parts, steps, means, etc., other than those specifically described herein. In addition, this disclosure may include other inventions not presently claimed, but which may be claimed in future.

The invention claimed is:

1. An aerosol delivery device comprising a power source and a controller, the controller being configured to control delivery of power from the power source to an aerosol-generating component during a single aerosol-generation event according to a first power delivery profile and a subsequent power delivery profile having a different profile to the first power delivery profile, wherein the first power delivery profile has a predetermined output based on the voltage of the power source, wherein the predetermined output of the first power delivery profile is a predetermined power or average power of the first power delivery profile, and wherein the predetermined power or average power of the first power delivery profile is greater than the power or average power output of the subsequent power delivery profile.

2. The aerosol delivery device of claim 1, wherein the subsequent power delivery profile has a predetermined output.

3. The aerosol delivery device of claim 1, wherein the predetermined power or average power of the first power delivery profile is from about 0.5 to 5 W greater than the power or average power of the subsequent power delivery profile.

4. The aerosol delivery device of claim 1, wherein the predetermined output of the first power delivery profile is selected so as to provide from 5 to 50% of a total energy delivered during both the first and subsequent power delivery profiles.

5. The aerosol delivery device of claim 1, wherein the predetermined output is within a predetermined energy range, wherein the predetermined energy range of the first power delivery profile is from 12J to 1J.

6. The aerosol delivery device of claim 1, wherein the first power delivery profile is delivered for between 100 ms and 900 ms.

7. The aerosol delivery device of claim 1, wherein the aerosol-generating component comprises a heater.

8. The aerosol delivery device of claim 7, wherein the heater is formed from an electrically resistive material.

9. The aerosol delivery device of claim 8, wherein the electrically resistive material has a resistance of from 0.1 to 2 Ohms.

10. The aerosol delivery device of claim 1, wherein the predetermined power output of the first power delivery profile is determined based on a time to initial aerosol formation being less than 0.8s.

11. The aerosol delivery device of claim 1, wherein the predetermined power output of the first power delivery profile is determined based on a time to maximum aerosol density being less than 2s.

12. An aerosol delivery system comprising the aerosol delivery device of claim 1, and further comprising an article containing aerosolizable material.

13. The aerosol delivery system of claim 12, wherein the aerosol-generating component forms part of the article.

14. The aerosol delivery system of claim 12, wherein the aerosol-generating component forms part of the aerosol delivery device.

* * * * *